United States Patent [19]

Lappa

[11] 4,010,719

[45] Mar. 8, 1977

[54] ROTARY INTERNAL COMBUSTION ENGINE

[76] Inventor: Cleto L. Lappa, 541 Torwood Lane, Pittsburgh, Pa. 15236

[22] Filed: Jan. 22, 1975

[21] Appl. No.: 543,135

Related U.S. Application Data

[63] Continuation of Ser. No. 357,195, May 4, 1973, abandoned.

[52] U.S. Cl. ..... 123/44 C; 123/18 R; 123/44 D

[51] Int. Cl.[2] ..... F02B 57/04; F02B 57/08

[58] Field of Search ..... 123/44 R, 44 C, 44 D

[56] References Cited

UNITED STATES PATENTS

| | | | |
|---|---|---|---|
| 743,230 | 11/1903 | Blasdell | 123/44 C |
| 780,013 | 1/1905 | Parnall et al. | 123/44 C |
| 1,084,192 | 1/1914 | Becker et al. | 123/44 R |
| 1,151,568 | 8/1915 | Conill | 123/44 R |
| 1,292,295 | 1/1919 | Freer | 123/44 D |
| 1,315,897 | 9/1919 | Aber | 123/44 D |
| 1,331,749 | 2/1920 | Freer | 123/44 D |
| 1,915,582 | 6/1933 | Sklenar | 123/44 D |
| 2,242,231 | 5/1941 | Cantoni | 123/44 D |
| 2,273,025 | 2/1942 | Dillstrom | 123/44 D |
| 3,167,058 | 1/1965 | Czike et al. | 123/44 D |
| 3,205,877 | 9/1965 | Rychlik | 123/44 D |
| 3,857,371 | 12/1974 | Gibson | 123/44 D X |
| 3,921,602 | 11/1975 | Froumajou | 123/44 D |

*Primary Examiner*—Carlton R. Croyle
*Assistant Examiner*—Michael Koczo, Jr.
*Attorney, Agent, or Firm*—William J. Ruano

[57] ABSTRACT

A rotary internal combustion engine comprising a cylindrical housing with end walls, a rotating cylinder block therein having seals mounted on the outer arcuate surface of the rotating cylindrical block as well as the end surfaces thereof to provide a tight seal with the inner walls of the housing. A plurality of radially extending cylinders are provided in the rotating block, each including a piston. Connecting rods are eccentrically mounted on a single throw or single connecting pin of a crank shaft. The cylinders are offset about one-half inch axially of the crank shaft so that they reciprocate in substantially the same plane. Different sun gear arrangements are provided to enable rotation of the rotating block either in the same direction or in an opposite direction relative to the crank shaft to obtain different ratios and different numbers of power strokes per revolution of the cylindrical block. Either two pistons 180° apart or three pistons 120° apart are provided. In one modification, the rotating block merely oscillates relative to two radially extending, stationary partitions 180° apart within the housing which, together with a crank assembly, converts oscillations to rotation of an output shaft.

2 Claims, 43 Drawing Figures

ROTARY INTERNAL COMBUSTION ENGINE

This is a continuation of application Ser. No. 357,195, filed May 4, 1973, and now abandoned.

This invention relates to a rotary internal combustion engine and, more particularly, to improvements therein for overcoming the disadvantages of currently used rotary engines.

Rotary internal combustion engines are quite old in the art but have never been practical or commercially adopted to any appreciable extent until the very recent adoption of the so-called Wankel engine. This is essentially an engine involving a somewhat triangular shaped rotor and eccentriccam, the rotor apices sliding with seals on the internal cylindrical surface of a housing or block. While the Wankel engine has provided significant improvements in the art, so as to make, for the first time, a practical rotary engine, it still possesses many disadvantages as compared to the commonly used reciprocating piston engine.

Certain of the disadvantages are difficulty in maintaining seals, harder starting, higher fuel comsumption, lower spark plug life, lower torque, and higher cost of manufacture. More specifically, difficulty in maintaining seals arises from the fact that when designed for high speed and high power, they wear too fast in city driving with an insufficiently warm engine as a result of "cold corrosion" of the seal. It is far more expensive to manufacture a Wankel type engine than conventional reciprocating pistons engines because of totally unconventional parts used in a Wankel engine. For starting, Wankel engines require a bigger battery and a heavy duty motor as well as cooler for the oil. Moreover a two rotor Wankel engine cannot perform in the V8 Class, as far as smoothness is concerned. The internal friction of Wankel engines is higher at low speeds than for reciprocating engines. The higher fuel consumption of the Wankel engine makes it uneconomical for very small cars. The Wankel's ratio of chamber surface area enclosed volume is greater and similar to that of the old L-head designs the auto industry discarded during the 1950's.

The Wankels get 10 to 15% less mileage than comparable reciprocating engines, therefore making fuel economy a major problem. The oil consumption of the Wankel engine is also greater, requiring frequent addition of oil, which purchasers dislike, being about 1000 miles per quart, as compared to 5 or 6 thousand miles per quart presently obtainable in reciprocating engines. The spark plug life is only about one-fourth of that in conventional reciprocating engines since they have to work harder and fire more frequently under consistently hotter conditions than in the piston engines. Overheating is a serious problem in Wankel engines which tends to "crush" the multi-part bolted housing enough to require complete replacement.

Another serious problem of the Wankel engine is that its very intricate construction and close tolerances required necessitate very highly skilled mechanics as compared to present day mechanics and old timers who are familiar with reciprocating engines, making service in the neighborhood garage an impossibility.

An object of my invention is to provide a novel hybrid rotary engine that has essentially all the advantages of the Wankel rotary type engine and practically none of the abovementioned disadvantages thereof, yet retaining the efficiency of the conventional piston engine.

A more specific object of the present invention is to provide a rotary engine having all the benefits of the Wankel type engines by providing substantially continuous application of power in a rotary path, but possessing no intricately constructed rotor, as in the Wankel engine by using, instead, reciprocating engine cylinders assembled in a very unique manner thereby eliminating all the abovementioned disadvantages of a Wankel engine and retaining all the advantages of a reciprocating engine, such as lower cost, lower maintenance, lower fuel consumption, higher torque, greater spark life, lower oil consumption, etc.

Other objects and advantages will become more apparent from a study of the following description, taken with the accompanying drawings, wherein.

Figure 1:
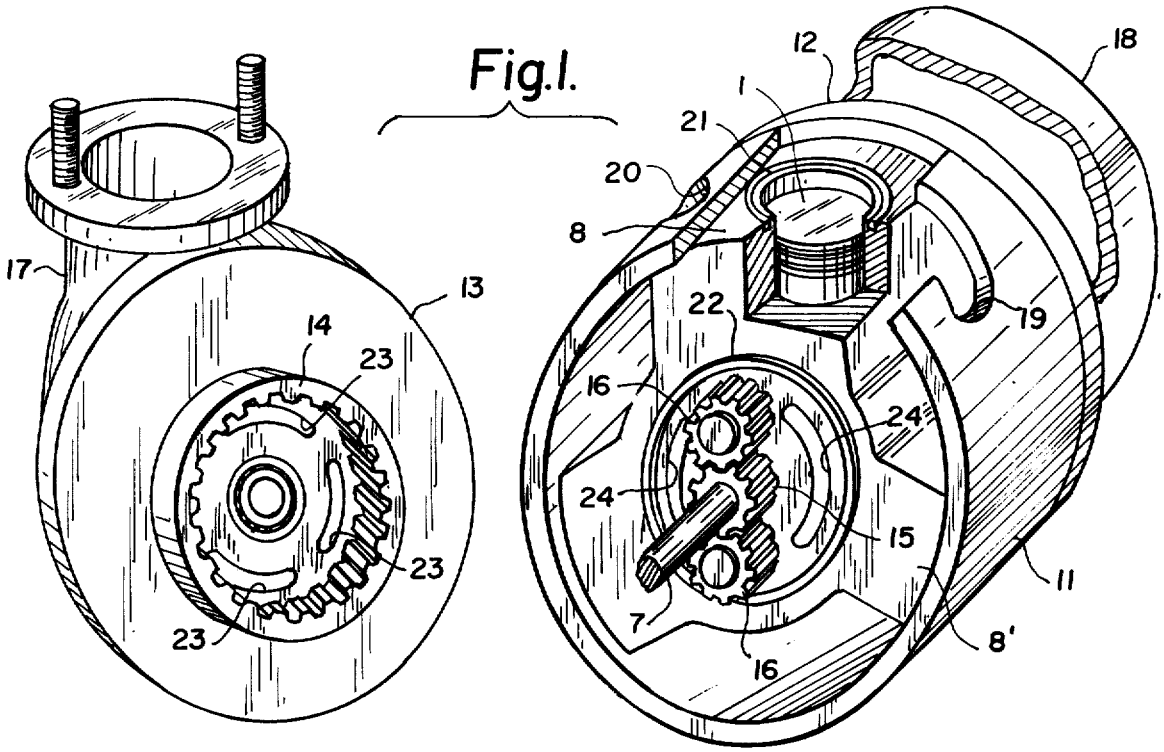
FIG. 1 is a top perspective exploded view showing two separate parts of the rotary engine embodying the present invention, which parts are normally fastened together in the manner shown in FIG. 2.
Figure 4:
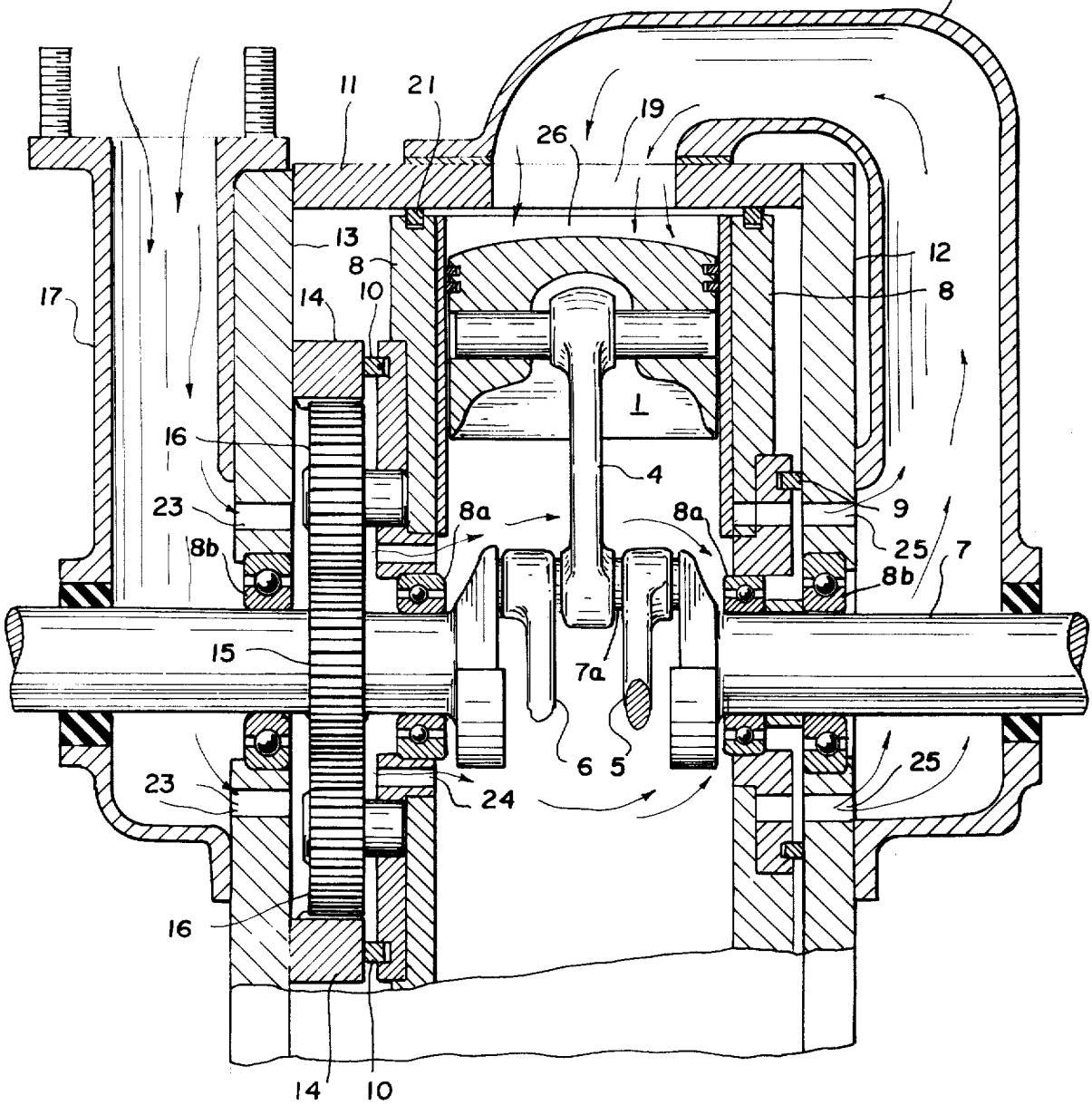
FIG. 4 is a longitudinal, cross-sectional view taken along line IV—IV of FIG. 3.
Figure 5:
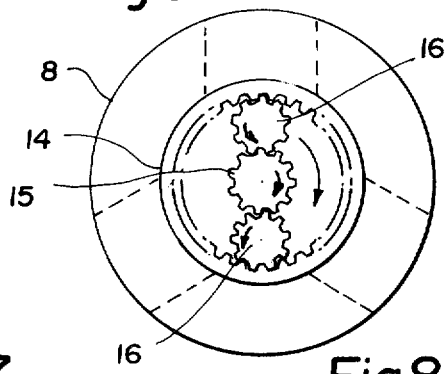
FIG. 5 is an end view as seen from the left side of FIG. 2 and illustrated schematically.
Figure 6:
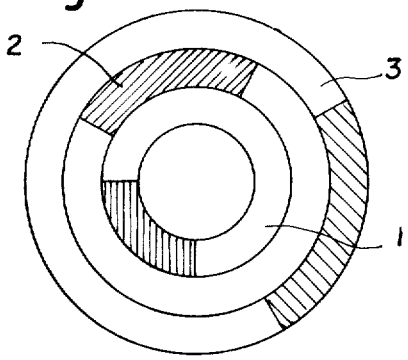
FIG. 6 is a diagrammatic drawing of the firing cycles of the respective cylinders; which cycles are represented by shading.
Figure 16:
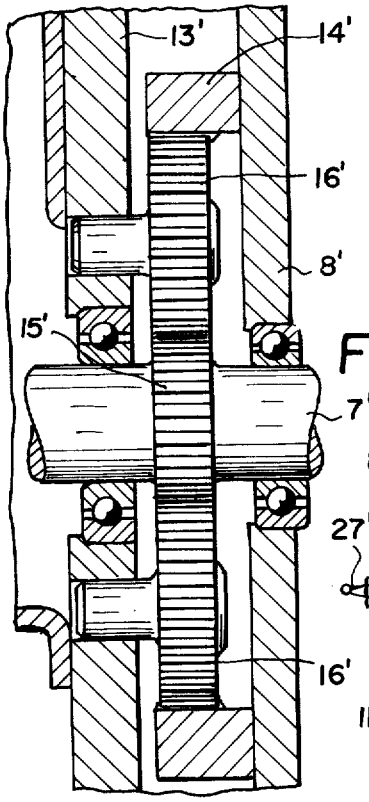
Figure 17:
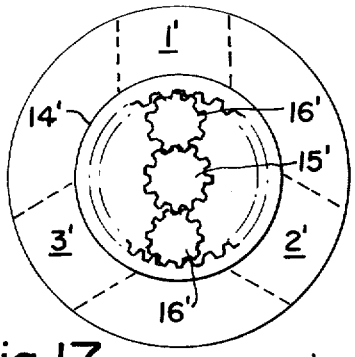
Figure 18:
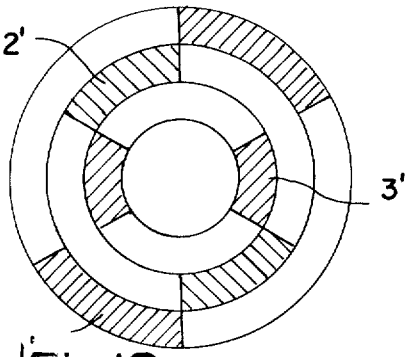
Figure 19:
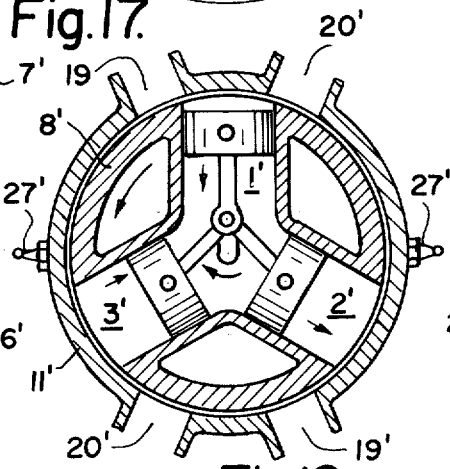
Figure 25:
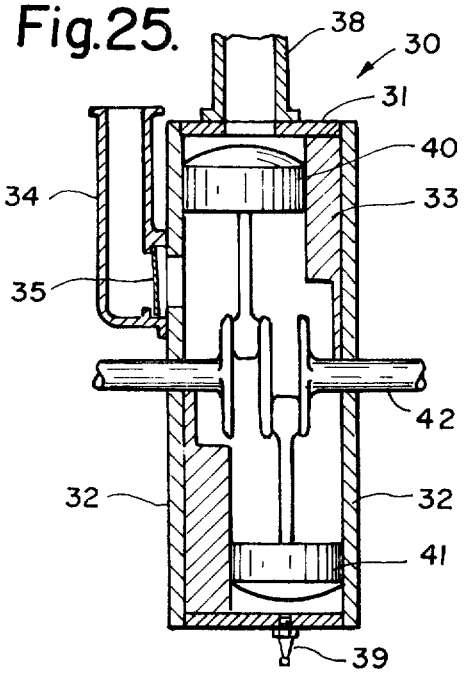
Figure 26:
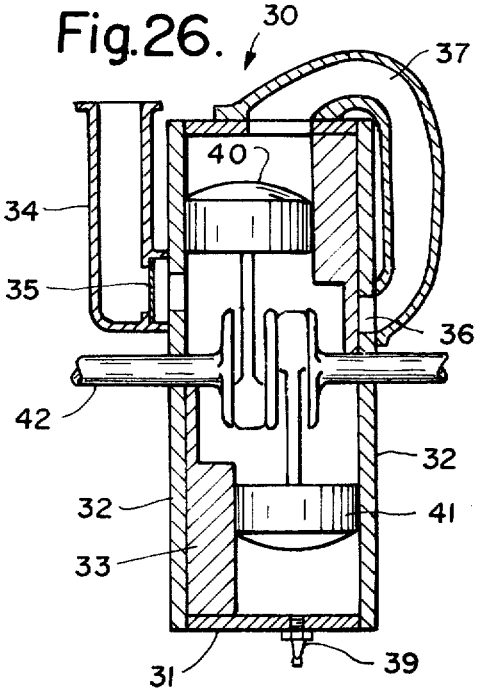
Figure 32:
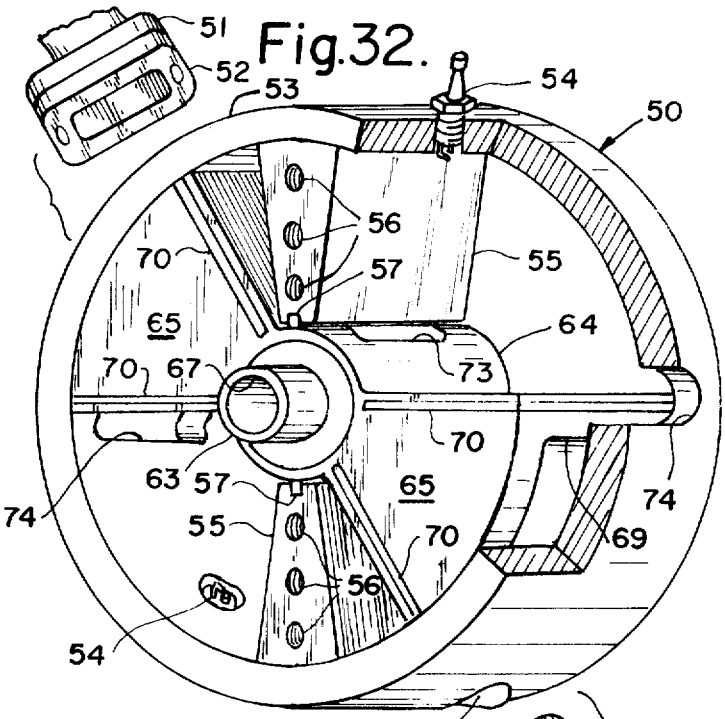
Figure 33:
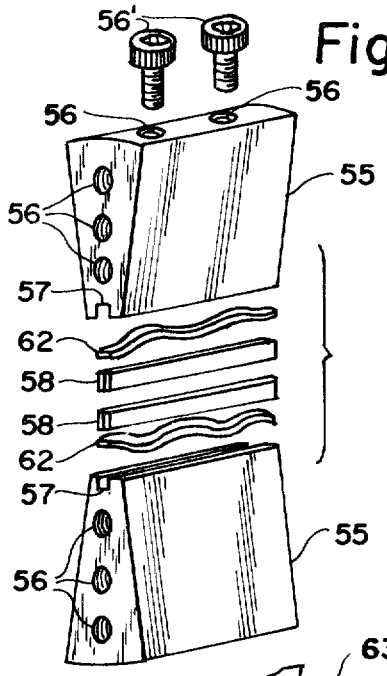
Figure 38:
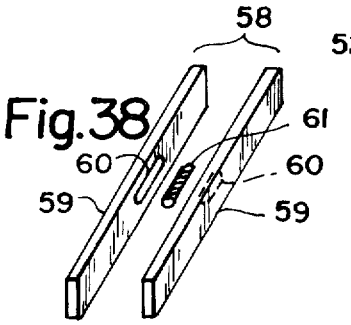
Figure 37:
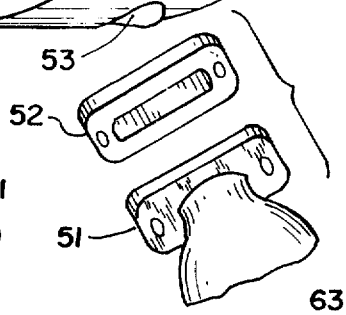
Figure 37:
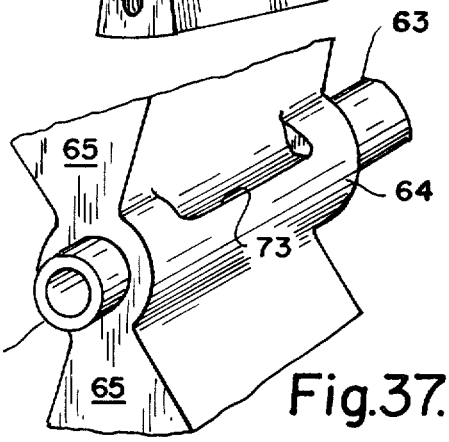
Figure 34:
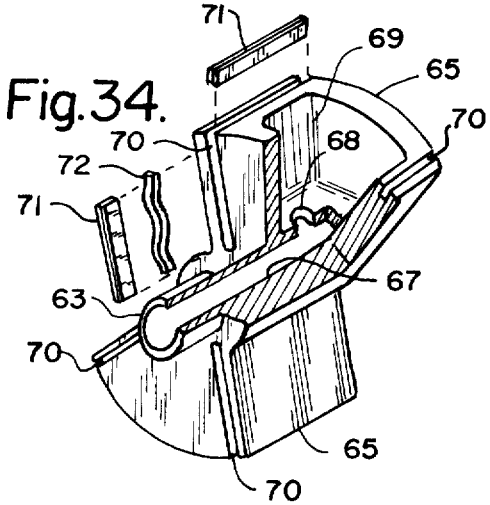
Figure 35:
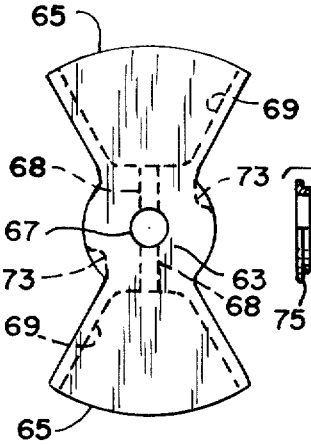
Figure 36:
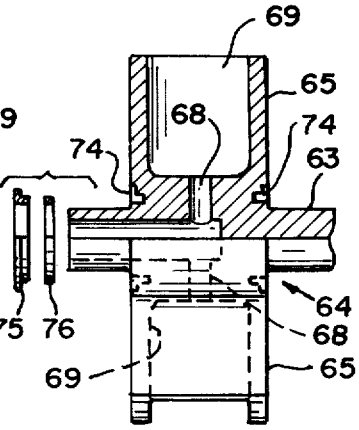
Figure 39:
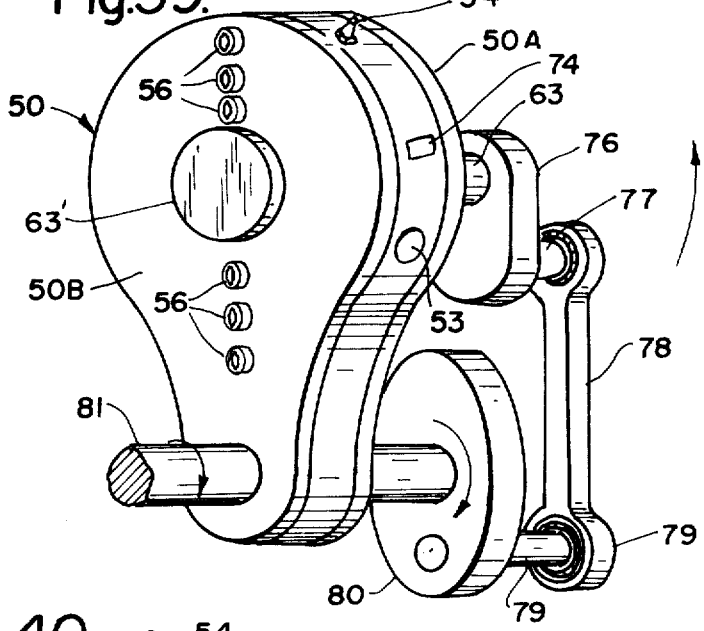

FIGS. 7 to 15 inclusive show diagrammatically, successive positions of the pistons of a three cylinder engine embodying the present invention, illustrating how the rotating engine block 8 rotates one-third as fast as the crank shaft 7;

FIG. 16 is a fragmentary, cross-sectional view of a modification of the mode of attachment of the ring gear shown in FIGS. 1 and 4;

FIGS. 17 and 18 are schematic showings, similar to FIGS. 5 and 6, respectively, when the modified gear mounting of FIG. 16 is used;

FIGS. 19 to 24, inclusive show, diagrammatically, successive positions of the rotating block 8 and crank shaft 7' to illustrate the different rotational ratio therebetween when the modified gear construction of FIG. 16 is used;

FIGS. 25 and 26 show a further modification of the invention embodying a two piston engine;

FIGS. 27 to 31 inclusive show, diagrammatically, successive positions of the two piston engine modification;

FIG. 32 is a top, perspective view of a still further modification of the invention wherein the rotor 55 oscillates instead of rotating;

FIG. 33 is a perspective, exploded view of the rotor assembly shown in FIG. 32;

FIGS. 34, 35 and 36 are exploded views in top perspective with portions cut-away; side view, and longitudinal view in partial cross-section, respectively of block 65 in FIG. 32;

FIG. 37 is a fragmentary, top perspective view of a modified rotor or block 65;

FIG. 38 is an exploded, perspective view of spring-biased parts of the seal;

FIG. 39 is a perspective view of the completed assembly including the structure of FIG. 32 and crank assembly; and, FIGS. 40 to 43 inclusive show, diagrammatically, the successive positions when using the modified construction illustrated in FIGS. 32 to 39 inclusive.

Figure 2:
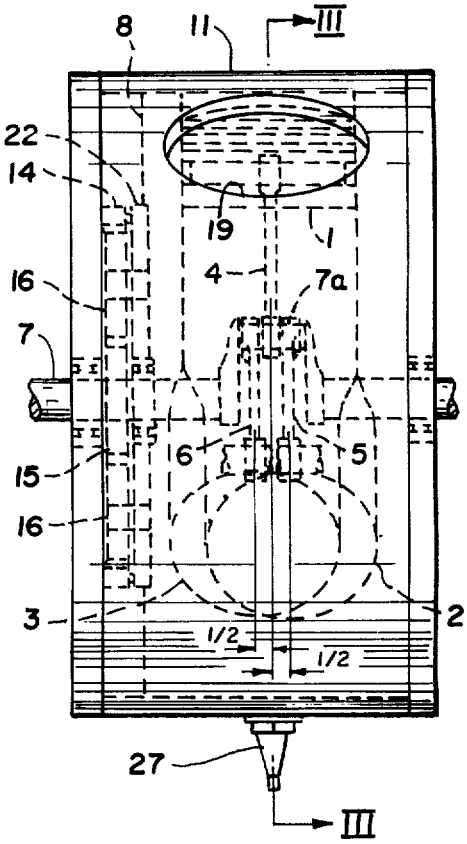
FIG. 2 is a side view of the assembled parts shown in FIG. 1.

Referring more particularly to FIGS. 1 to 4 inclusive of the drawings, which show a rotary internal combustion engine having three cylinders and embodying the principles of the present invention, numerals 1, 2 and 3 denote the three pistons which are pivotally connected with one end of connecting rods 4, 5 and 6, respectively, which rods, in turn, have their other ends pivotally connected to a crank pin 7*a*. A unique feature of the invention is that connecting rods 4, 5 and 6, which are spaced about a half inch apart as illustrated in FIG. 2, are all pivotally connected to a single crank pin 72 or single throw so that the three pistons and cylinders are arranged in substantially the same plane, however, being slightly offset from such single plane, as more clearly illustrated in FIG. 2 (see pistons 2 and 3).

Figure 3:
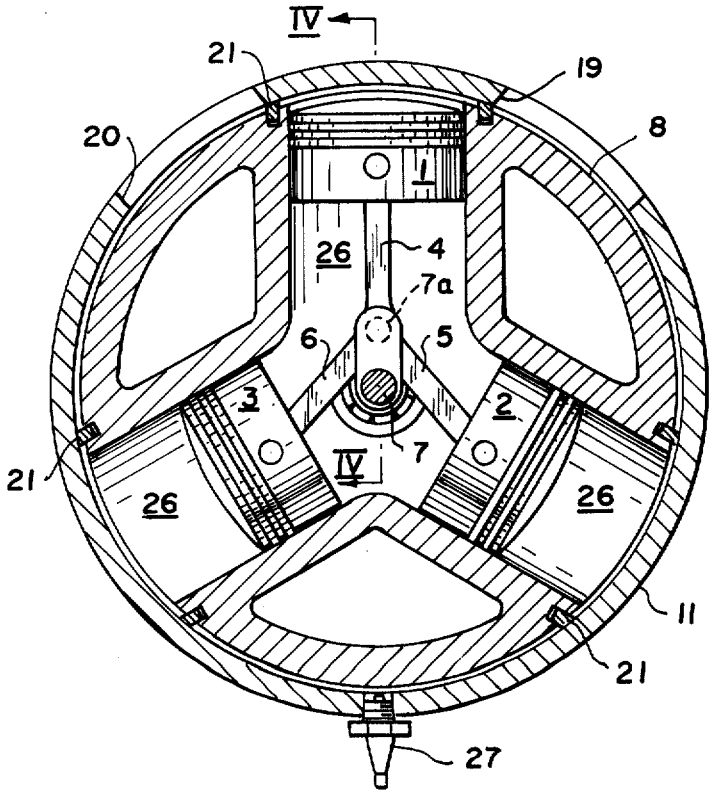
FIG. 3 is a vertical, cross-sectional view taken along line III—III of FIG. 2.

The rotary internal combustion engine comprises a center housing 11 of hollow cylindrical shape inside which rotates a somewhat cylindrical block 8 (see FIG. 3) supported by ball bearings 8*a* see FIG. 4) on crank shaft 7. The three bores or cylinders 26 in block 8, shown in FIG. 3, are spaced 120° apart.

The crank shaft 7 has rigidly mounted thereon a gear 15, such as by keying thereto. Crank shaft 7 is supported by two ball bearings 8*b*, 8*b*, which are mounted, one in each side cover 12 and side cover 13. On the left side, as illustrated in FIG. 4, of the engine block 8 are mounted two idler gears 16 which, in turn, mesh with crank gear 15 and the internal teeth of ring gear 14 stationarily mounted on the side cover 13. On the sides of cylinder block 8 are also mounted two pinned sealing rings 9 and 10 to provide a seal which will confine the fuel mixture inside the engine.

On one side cover 13 there is mounted an intake manifold 17 which also accepts the carburetor (not shown) mountable therein. A complementary intake manifold 18 is mounted on the other side, that is, on the side cover 12 and on the top center of engine housing 11 mating with the intake port 19. The exhaust port 20 (FIG. 3) is attached to an exhaust system.

Also on the outer surface of cylinder block 8 are mounted three circular sealing rings 21 which encircle the top opening of each of the three cylinders 26 (FIG. 1). The outer surfaces of these rings 21 are arcuate and are ground to the radius of the inside cylindrical surface of the engine housing 11 to effect a reliable seal between the rotating cylinder block 8 and stationary housing 11.

There are also openings 23, 24, 25 on both sides of the cylinder block 8 and both end covers for fuel, air and oil passages.

In operation, as crank shaft 7 begins turning in a clockwise direction, as viewed in FIG. 3, crank shaft gear 15 meshed with idler gears 16 rotatably mounted on block 8 are meshed with the stationary internal ring gear 14, therefore are forced to turn in a counterclockwise direction against the stationary gear 14. Since the stationary gear 14 is rigidly attached to the side engine cover 13 which is stationary, idler gears 16 are forced to move in a clockwise direction. Since idler gears 16 are mounted on cylindrical block 8, it too is forced to turn in a clockwise direction. Since the gear ratio is 3 to 1, crank shaft 7 turns three revolutions to every revolution of the cylinder block 8, as illustrated. More clearly in FIGS. 7 to 15 inclusive showing successive positions of the pistons during one complete revolution of the cylinder block 8.

Figure 7:
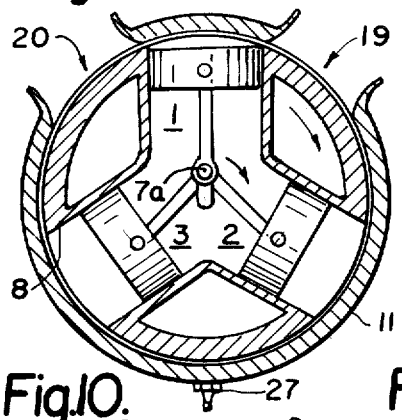
Figure 8:
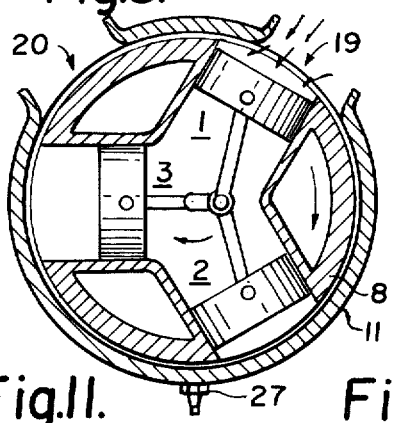

In FIGS. 3 and 7, piston 1 is at top dead center, and in FIG. 8, the crank shaft has rotated 90° whereas the cylinder block 8 has followed by 30°, while piston 1 begins its downward intake stroke drawing fuel, air, oil mixture behind it. The fuel-air mixture originating at the carburetor enters intake manifold 17 drawn through openings 23 in the side engine cover 13, thence through openings 24 in the rotating cylinder block 8 and through openings 25 on the other side into manifold 18, thence through intake ports 19 into the cylinders. The air, oil and fuel mixture lubricates the bearings, gears and internal engine parts on its way. The mixture is confined inside the engine by sealing rings 9 and 10, which rings are pinned to prevent rotation.

Figure 9:
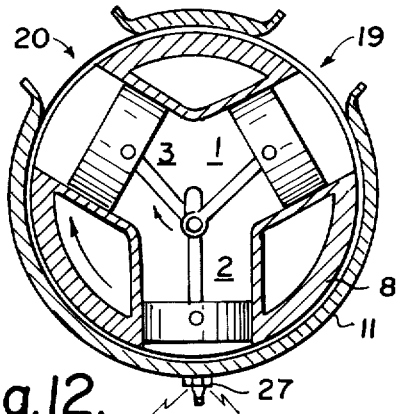
Figure 10:
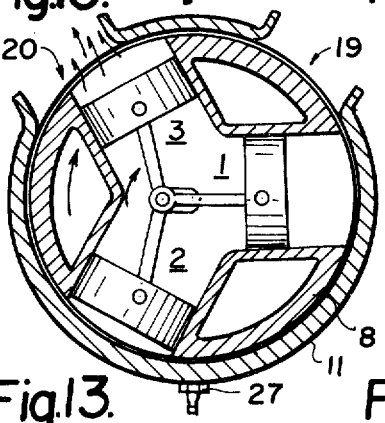

In FIG. 9, crank shaft 7*a* has moved 180° and the cylinder of piston 1 has turned 60° after the top dead center position and piston 1 will continue to move downwardly drawing fuel behind it until, as shown in FIG. 10, the crank shaft 7 has rotated 270°, whereas the cylinder of piston 1 has rotated 90° and piston 1 has completed the intake stroke at the bottom of dead center.

Figure 11:
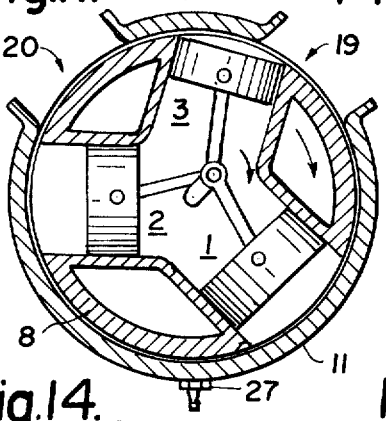
Figure 12:
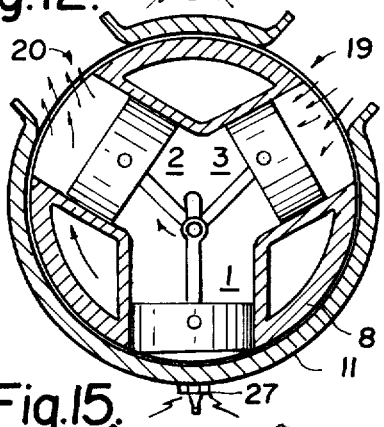
Figure 13:
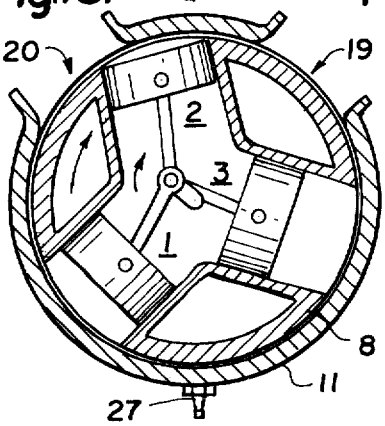
Figure 14:
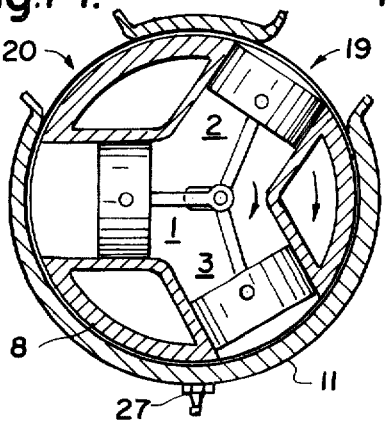
Figure 15:
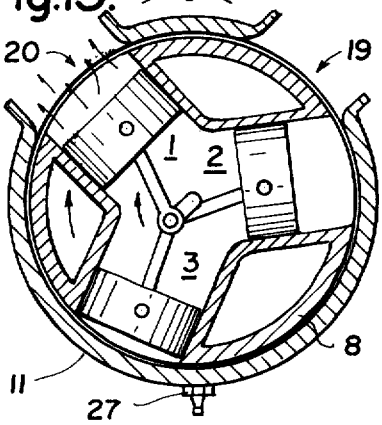

In FIG. 11, piston 1 is in compression and in FIG. 12 it has arrived to top dead center and firing. In FIG. 13, piston 1 in the power stroke continues to bottom dead center as shown in FIG. 12, completing its power stroke, exhausting through port 20 and intaking through port 19. FIGS. 14 and 15 show successive positions to the starting position, having traveled 360°, while the crank shaft 7 has completed 1080° or three revolutions. Pistons 2 and 3 follow in a like manner 120° apart. In effect, there is obtained three power strokes in three revolutions of the crank shaft.

In FIG. 14, the fuel-air-oil mixture is admitted through inlet port 19. In FIG. 15, piston 1 effects exhaust thereof through exhaust port 20. An examination of FIG. 6 which, in cross-section, shows the periods during which there occurs a power stroke, that there are three power strokes for a complete revolution of any one piston of the rotating block 8.

FIG. 16 shows a modification of the invention wherein the center engine housing 11 of FIG. 4 with its single intake 19 and single exhaust 20 is now replaced by housing 11′ (FIG. 19) having two intake ports 19′, 19′ and two exhaust ports 20′, 20′ — that is, twice the original number, and wherein idler gears 16′ (FIG. 16) are mounted on the engine cover 13′, instead of mounting the ring gear thereon, and wherein the ring gear 14′ is, instead, mounted on cylinder block 8′. The gear ratio is still 3 to 1, but as the crank shaft 7′ turns in a clockwise direction, the cylinder or block 8′ now turns in a counterclockwise direction. This opposite motion of the cylinder block 8′ relative to crank shaft 7′ causes each piston to complete its own cycle in 540°. The total effect and end result is that six power strokes occur for three revolutions of the crank shaft, as illustrated by the cross-sectional areas of FIG. 18 representing power strokes and their durations. Thus, twice as many power strokes are obtained as compared to those for Gis. 3 and 4 illustrated in FIG. 6; which is the equivalent of a four cylinder, four cycle, conventional engine. The mountings for the respective pistons are the same as illustrated in FIGS. 2 and 3, — that is, all three cylinders are connected to a single throw or single crank pin, such as 7*a* of FIG. 2.

Figure 20:
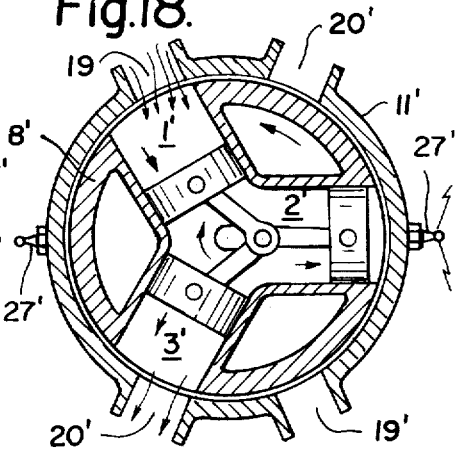
Figure 21:
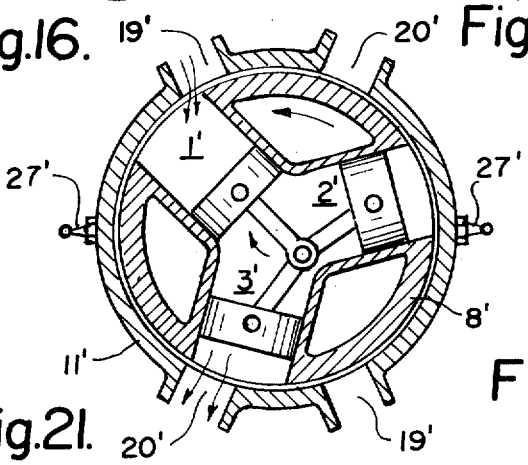
Figure 22:
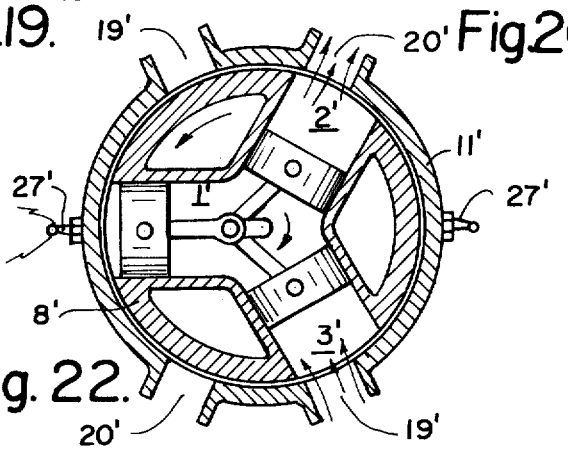
Figure 23:
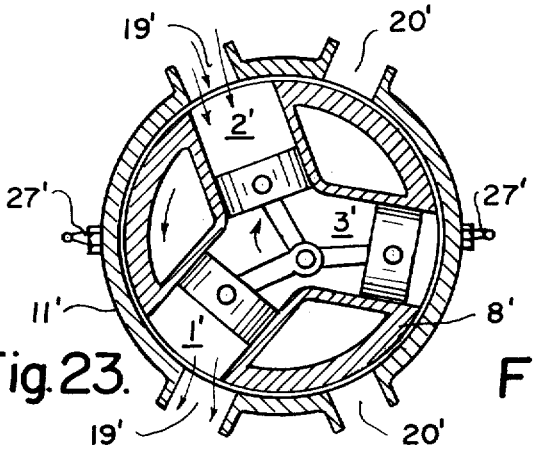
Figure 24:
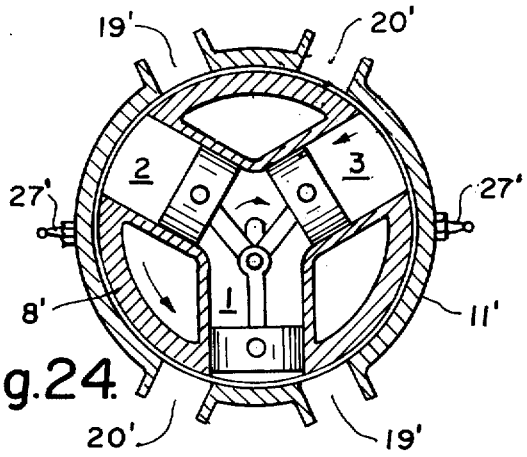

FIGS. 19 to 24, inclusive, show the successive positions of the pistons and cylinder block 8'. In FIG. 20, plug 27' at the right fires, causing inward thrust of piston 2 as illustrated in FIG. 18. In FIG. 21, the right plug 27' fires; in FIG. 22, the left plug 27' fires; and in FIG. 23 the right plug 27' fires. FIG. 18 shows the number of power strokes, illustrated in cross section, and the duration of such power strokes of the successive pistons throughout a complete revolution of the block 8', — namely, 6 power strokes per revolution of the block 8'.

Figure 27:
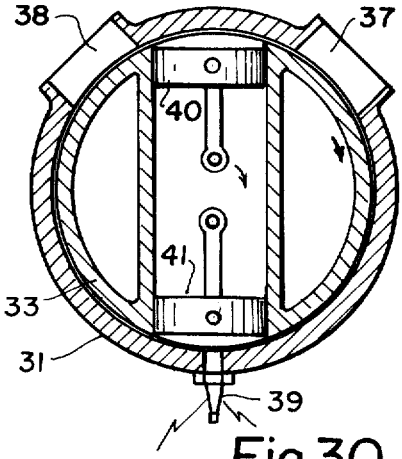
Figure 28:
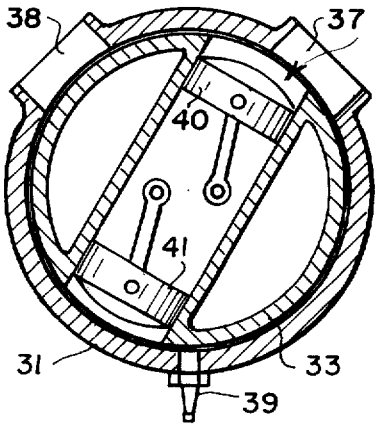

FIGS. 25 and 26 show a further modification embodying only two pistons 40, 41, mounted on crank shaft 42 and contained within a center hollow cylindrical housing 31 and rotating block 33, including sidewalls 32, 32, of the housing. The fuel mixture is introduced from the carburetor through inlet port 34 and through the one-way reed valve 35, which is now open. Both pistons 40, 41, are now on the way out (away from crank shaft 42) displacing twice the capacity of one cylinder while drawing fuel mixture through the one-way reed valve 35. The engine is now in the position illustrated in FIG. 27 showing an intake port 37 and an exhaust port 38 and in which position plug 39 will fire. As a consequence of such firing, the pistons 40, 41, are forced to the position shown in FIG. 26 wherein valve 35 is in the closed position. Now twice the displacement of mixture is forced into each cylinder, alternately, the structure acting as a built-in supercharger in which the mixture can be drawn outwardly through port 36, thence through conduit 37 at the proper time during rotation.

Figure 29:
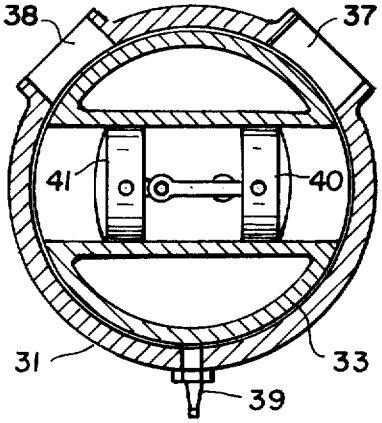
Figure 30:
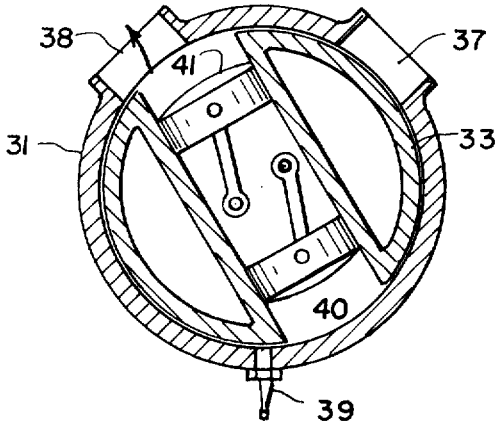
Figure 31:
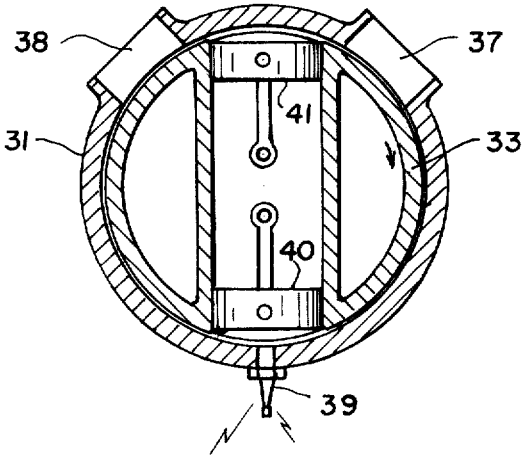

FIGS. 27 to 31, inclusive, show the successive positions of the double piston arrangement. In FIG. 27, plug 39 is in the firing position, causing movement of the pistons to the next position shown in FIG. 28, during which the gaseous mixture is introduced through intake port 37. FIG. 29 shows both pistons moving inwardly toward each other. FIG. 30 shows piston 41 exhausting through port 38 while piston 40 is in compression. FIG. 31 shows plug 39 firing while pistons 40 and 41 are in their outward positions. As a further modification, the engine may be built-in multiples of two, four, three or six figure configurations.

FIGS. 32 to 43, inclusive, show a further modification involving a two cycle internal combustion engine comprising only one internal moving part and anti-pollution features. The engine comprises a circular housing 50, two stationary dividing sectors 55, one oscillating rotor or block 65, and two end covers 50A and 50B including bearings which support the rotor. The engine also includes two spark plugs 54 which fire simultaneously, two exhaust ports 74 and two intake ports 53. Two carburetors 51 and two one-way valves 52 are also provided.

FIG. 32 shows the internal construction of the engine having only one internal moving part, namely, rotor 65, which oscillates, instead of rotating as in previous modifications, and which incorporates anti-pollution features. The engine provides preheating and compression of the mixture, a built-in air passage through the rotor to the exhaust ports to dilute exhaust gases and extremely high primary compression or scavenging pressure to assist such dilution.

At the radially inward ends of the partitions or dividing sectors 55 are two sets of spring-pressed sealing bar assemblies 58 (FIGS. 33 and 38) which slide over the outer arcuate surface of hub 64 of rotating block 65 which is integral with hub 64.

FIG. 38 shows a sealing bar assembly 58 comprising two sealing bars 59, 59 and a coil spring 61 which fits into slots 60, 60 on the confronting surface of the sealing bars. Rotor or block 65 is provided along its sidewalls and its outer arcuate walls with sealing bars 71 (See FIG. 34) yieldingly urged outwardly by leaf springs 72 in slots 70 for providing a sliding seal between the oscillating block 65 and end or side covers 50A and 50B.

Figure 40:
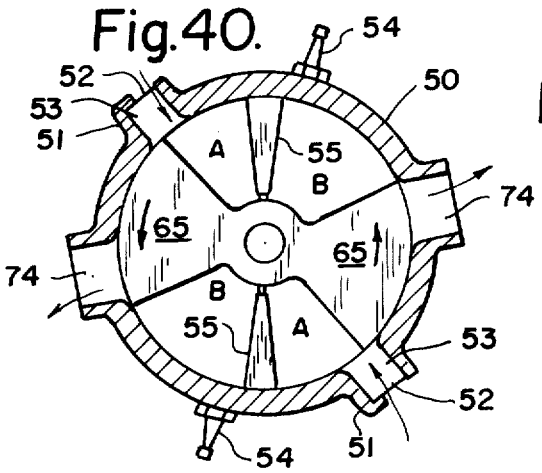

Numeral 51 (upper left) denotes a carburetor and 52 denotes a one-way reed valve mounted on inlet port 53 (FIG. 40).

Similarly, numeral 51 at the bottom of FIG. 32 denotes another carburetor and numeral 52 another one-way reed valve associated with intake port 53.

FIGS. 34, 36, and 37 show the oscillating block 65 as being hollowed to allow the flow of cooling air through the hollow shaft 63 and hollow portion 69 of rotor 65 into exhaust ports 74 helping to burn unburned fuel and diluting exhaust, thereby greatly minimizing pollution of the atmosphere. Well portions 73 are milled out in rotor 65 to provide transfer ports for by-passing between chambers A and B.

Referring more specifically to FIGS. 32 and 33 of the drawing, numeral 55 denotes a stationary vane rigidly attached to the center cylinder 50 by means of bolts 56' which are screw threaded into threaded hole 56 (FIG. 33). A seal is assembled in each slot 57 into which is fitted a leaf spring 62 and sealing bar 58.

FIG. 36 shows radial holes 68 in block 65 and end rings 75 and spring 76, as well as outer circular grooves 74 for receiving said end rings.

FIG. 39 shows a complete assembly comprising a two cycle engine, as shown in FIG. 32, together with the sidewalls 50A, 50B bolted by bolts 56, also the crank assembly comprising a fly wheel 80, crank pins 77 and 79, connecting rod 78 and crank arm 76 and shaft 63 and part of rotor 65. The hollow end of shaft 63 is covered by a perforated cover plate 63'. Thus rotating motion of drive shaft 81 is obtained from reciprocating motion of the shaft 63 and crank arm 76.

Figure 41:
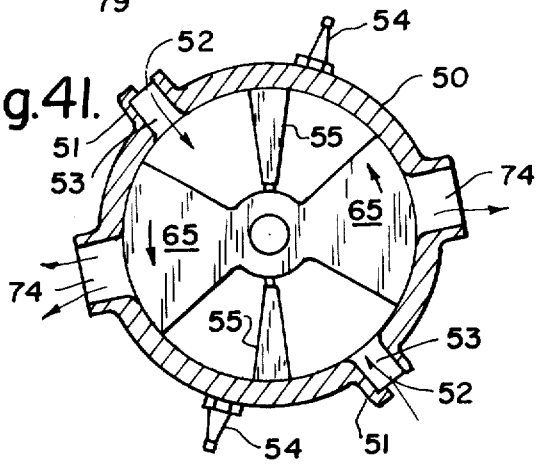
Figure 42:
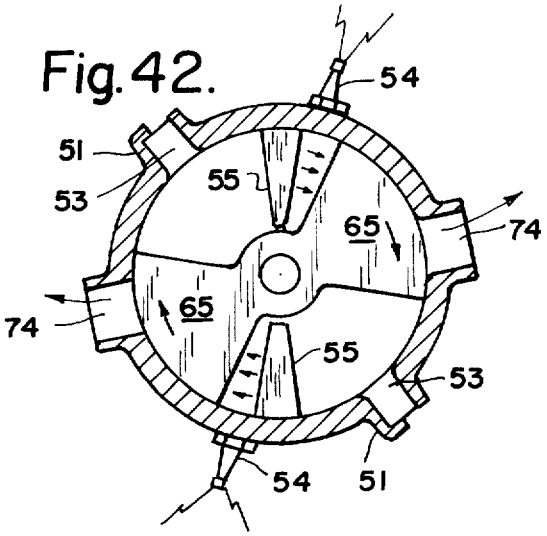
Figure 43:
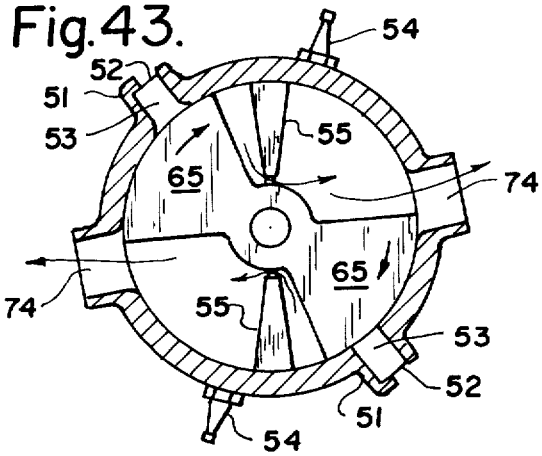

In operation, (FIG. 40) rotor 65 turns counterclockwise, it draws in fuel-oil mixture through ports 53 past reeds 52 into chambers A. Meanwhile mixtures in chambers B are in compression. In FIG. 41, the rotor 65 has moved even farther. In FIG. 42, the rotor 65 has arrived to top dead center. The two plugs have fired and the rotor reverses itself into the power stroke. In FIG. 43, the exhaust ports 74 have opened, — an interval of time later. Transfer slots 73 on rotor 65 are exposed allowing the highly compressed mixtures in chambers A to transfer into chambers B, thereby scavenging and filling chambers B. The cycle then repeats itself. The oscillating rotor motion is then converted into rotary motion by crank arm 76 connecting rod 78 and fly wheel 80.

Cooling air is directed into hollow shaft 63 through holes 68 into hollow 69 of rotor 65, emptying into exhaust ports 74, helping to burn residual (unburned fuel) and diluting exhaust gases.

The outstanding and unique features of the two cycle engine shown in FIGS. 32 to 43 are as follows: one moving internal part; very high torque; two simultaneous firings; a unique seal design of two pieces; extreme compactness; unique scavenging slot 73; utmost simplicity; very high scavenging pressures; preheating the mixture and higher press to effect easier burning; unique cooling system to direct air through the rotor for diluting the exhaust, thereby effecting an amazing decrease in air pollution from the exhaust pipe.

Thus it will be seen that I have provided a novel and highly efficient, four cycle rotary internal combustion engine which has many important advantages over the Wankel engine, such as lower cost of manufacture; lower maintenance cost; lower manufacturing tolerances; much fewer critical seals; greater selectivity in the number of firing impulses per revolution; capability of operating as a diesel; much greater fuel economy; greater volumetric efficiency; lower octane fuel and no valves; less pollution; much easier cold weather starting; and much greater spark plug life. Also I have provided a novel rotary internal combustion engine wherein six power strokes per revolution of the rotary block are available without an increase in crank shaft rpm or rotary block rpm. Also I have provided a housing having two cylinders operating in opposition in conjunction with reed valves to provide a self supercharging effect; also I have incorporated a supercharging effect to provide an increase in power, which supercharging effect provides more thorough burning, thereby reducing pollution.

While I have illustrated and described several embodiments of my invention, it will be understood that this is by way of illustration only and that various changes and modifications may be made within the scope of the following claims.

I claim:

1. A rotary internal combustion engine including a housing, together with a gaseous inlet port extending through a sidewall of said housing, a one-way reed valve in said port, a second port extending through the other sidewall of said housing, a gas intake port and an exhaust port in said housing cylindrical portion, said gas intake port connected to a conduit to said second port, said rotary block having a pair of radially extending cylinders 180° apart, a pair of pistons, each slidably mounted on one of said cylinders, a crank shaft including a double throw provided by a pair of crank pins, a pair of connecting rods, each having one end connected to one of said pistons and the other end connected to one of said crank pins, a spark plug mounted on said housing to ignite the gaseous mixture introduced in said gas intake port at the moment when said pistons are outermost to effect power impulse movements of said block, whereby when both pistons move radially outwardly whereupon said reed valve is drawn open, the fuel mixture drawn in will fill both cylinders, and when said reed valve is forced closed by movement of said pistons radially inwardly, said drawn in fuel mixture will be fed through said conduit and said gas intake port to a single piston to effect supercharging.

2. A rotary internal combustion engine, comprising a hollow cylindrical stationary housing having two sidewalls, a rotatably mounted, substantially cylindrical rotary block having a cylindrical outer surface slidable on the inner cylindrical surface of said housing, a gaseous inlet port extending through a sidewall of said housing, a one-way reed valve in said port, a second port extending through the other sidewall of said housing, a gas intake port and an exhaust port in said housing cylindrical portion, said gas intake port connected to a conduit to said second port, said rotary block having a pair of radially extending cylinders 180° apart, a pair of pistons, each slidably mounted on one of said cylinders, a crank shaft including a double throw provided by a pair of crank pins, a pair of connecting rods, each having one end connected to one of said crank pins, gear means between said rotary block and crank shaft to drive said rotary block in the same direction as said crank shaft and twice the rotational speed rate thereof, a spark plug mounted on said housing to ignite the gaseous mixture introduced in said gas intake port at the moment when said pistons are outermost to effect power impulse movements of said block, whereby when both pistons move radially outwardly whereupon said reed valve is drawn open, the fuel mixture drawn in will fill both cylinders, and when said reed valve is forced closed by movement of said pistons radially inwardly, said drawn in fuel mixture will be fed through said conduit and said gas intake port to a single piston to effect supercharging.

* * * * *